United States Patent [19]

Loughlin

[11] Patent Number: 4,589,127

[45] Date of Patent: May 13, 1986

[54] INDEPENDENT SIDEBAND AM MULTIPHONIC SYSTEM

[75] Inventor: Bernard D. Loughlin, Centerport, N.Y.

[73] Assignee: Hazeltine Corporation, Commack, N.Y.

[21] Appl. No.: 912,281

[22] Filed: Jun. 5, 1978

[51] Int. Cl.[4] ..... H04H 5/00

[52] U.S. Cl. ..... 381/16; 329/167; 332/40

[58] Field of Search ..... 179/165; 329/135, 167; 325/36, 47; 332/17, 21, 40; 381/16, 15

[56] References Cited

U.S. PATENT DOCUMENTS

| | | | |
|---|---|---|---|
| 3,068,475 | 12/1962 | Avins | 179/1 GS |
| 3,148,342 | 9/1964 | Holt | 179/1 GS |
| 3,218,393 | 11/1965 | Kahn | 179/1 GS |
| 3,908,090 | 9/1975 | Kahn | 179/1 GS |
| 4,018,994 | 4/1977 | Kahn | 179/1 GS |
| 4,079,204 | 3/1978 | Takahashi et al. | 179/1 GS |
| 4,159,398 | 6/1979 | Hilbert et al. | 179/1 GS |
| 4,184,046 | 1/1980 | Parker | 381/16 |
| 4,185,171 | 1/1980 | Parker | 381/16 |

*Primary Examiner*—Douglas W. Olms

*Attorney, Agent, or Firm*—E. A. Onders; F. R. Agovino

[57] ABSTRACT

An improved transmitter for a compatible independent sideband (ISB) AM stereo system develops a phase modulated carrier where the modulation represents the stereo difference signal inverse modulated by the stereo sum signal in accordance with a selected modulation function. The phase modulated carrier then is amplitude modulated by the stereo sum signal. This simplified modulation scheme provides the second-harmonic sideband correction required to develop a true single sideband type signal wherein left and right stereo information are transmitted in separate lower and upper sidebands, which can be demodulated without distortion in ISB AM stereo receivers. Simplified receivers which use inverse modulation are also disclosed.

2 Claims, 7 Drawing Figures

INDEPENDENT SIDEBAND AM MULTIPHONIC SYSTEM

BACKGROUND OF THE INVENTION

This invention relates to independent sideband (ISB) AM multiphonic systems, such as stereophonic systems for example, and in particular to transmitters for use therein where a second harmonic correction is provided to the stereo difference signal component as phase modulated on the carrier.

U.S. Pat. No. 3,218,393 discloses a system for transmitting stereophonic (stereo) information in an AM broadcast signal. The stereo signal is compatible with existing AM receivers. In accordance with that prior art system, the transmitter of which is shown in the FIG. 1 block diagram, separate L and R stereo signals are combined in subtracting circuit 10 and adding circuit 12, shown in FIG. 1, to form a stereo difference signal L−R and a stereo sum signal L+R. Phase shift networks 14 and 16 are provided to cause the sum and difference signals to have substantially a 90° audio phase difference.

A carrier signal originating at oscillator 18 is first phase modulated (PM) in phase modulator 20 with the phase shifted stereo difference signal information, amplitude limited in limiter 21 and then amplitude modulated in amplitude modulator 22 (AM) with the phase shifted stereo sum signal information. The output signal from amplitude modulator 22 is an independent sideband AM signal wherein the L and R stereo signal information appears separately in the lower and upper sidebands, respectively, of the AM signal.

The carrier may be generated and modulated at the frequency to be transmitted, but it is conventional in such transmitters to modulate a lower frequency carrier and then increase the carrier frequency to the frequency to be transmitted. Consequently, the term "carrier signal" is used herein to refer to both transmission frequency signals and lower frequency signals.

In order to illustrate the mathematics of the prior art AM stereo system transmitter shown in FIG. 1, it is convenient to assume the R signal has zero amplitude, in which case the stereo sum signal (L+R) is equal to the stereo difference signal (L−R). The 90° phase difference between the stereo sum and stereo difference signals, and the use of amplitude and phase modulation, with perpendicular modulation vectors, as illustrated in FIG. 4, results in a composite modulation phasor 24 which precesses around the carrier vector 26 with a single sense of rotation, for example, clockwise. This represents a single-sideband signal.

The ideal situation represented in FIG. 4 presupposes the existence of only a carrier and a fundamental upper sideband. This signal format is not the optimum for a compatible AM stereo system, since the envelope detection characteristics of standard AM receivers will demodulate therefrom a stereo sum signal (L+R) which is a distorted sine wave, shown as 28 in FIG. 5. The ideal detected signal, when the modulation consists of a single tone sine wave on only one of the stereo channels (L or R), is the natural sine wave 30, also shown in FIG. 5.

The actual composite signal generated by the prior art transmitter shown in FIG. 1 includes second harmonic AM and PM components, which are incidentally generated by the limiter-amplitude modulator combination 21–22 due to the multiplicative nature of the amplitude modulation process. The second harmonic AM component renders the signal detected by the envelope detector of a conventional AM receiver relatively distortion free. Since such a monophonic receiver essentially ignores the PM components, they do not affect the compatibility of the transmitted ISB AM stereo signal. However, the second harmonic PM component is almost twice what it should be for a true single sideband signal.

Prior U.S. Pat. No. 3,908,090 describes a transmitter for an ISB AM stereo system wherein a second harmonic correction of the stereo difference signal (L−R) is provided in order to reduce to the desired value of the second harmonic PM component which exists in the ISB AM stereo signal generated by the system. The improved prior art transmitter disclosed in U.S. Pat. No. 3,908,090, and shown in FIG. 2 hereof, includes components which are similar to those in the FIG. 1 system and which bear the same reference numerals. In addition, there is provided a circuit for adding a second harmonic correction to the stereo difference signal (L−R) prior to phase modulation of the carrier. The circuit includes phase shift networks 32 and 34 which provide the separate L and R stereo signals with a phase which is between that of the phase shifted stereo difference signal and the phase shifted stereo sum signal. Constant gain frequency doublers 36 and 38 are provided to double the frequency of the separate L and R stereo signals. The frequency doubled signals are then combined in subtractor 40. Variable gain amplifier 42 is responsive to the amplitude of the phase shifted stereo difference (L−R) signal, as detected in rectifier 44, and supplies a correction signal to adder 46. The correction signal is proportional to the square of the stereo difference signal amplitude and has a frequency of double the audio frequency of the stereo signal. The maximum amplitude of the correction signal is approximately 13% of the maximum amplitude of the stereo difference signal. The modified stereo difference signal that appears at the output of adder 46 is supplied to phase modulator 20 to modulate the carrier, after which the phase modulated carrier is amplitude in modulator 22 by the phase-shifted stereo sum signal (L+R) prior to transmission. Although this second harmonic correction of the stereo difference signal fully corrects for the excessive second harmonic PM component inherently generated in amplitude modulator 22, the desired second harmonic PM component represents distortion in the L−R phase modulation. Since a monophonic receiver essentially ignores the phase modulation in a received ISB AM stereo signal, compatibility of the signal is not affected. Furthermore, this L−R distortion can be cancelled in an ISB stereo receiver to provide a substantially distortion free L−R signal.

While this prior art transmitter provides the desired second harmonic correction for the transmitted ISB AM stereo signal, it should be evident from the drawing of FIG. 2 that considerable transmitter complexity is required for generating the correction signal.

U.S. Pat. No. 4,018,994 discloses a prior art ISB AM stereo receiver arrangement wherein amplitude modulation is used to remove from the received stereo difference signal component (L−R) the second harmonic correction component produced by the ISB AM stereo transmitter disclosed in U.S. Pat. No. 3,908,090 and shown in FIG. 2 hereof. In general, U.S. Pat. No. 4,018,994 discloses that the received stereo difference signal component may be amplitude modulated with one or more signals derived from the stereo sum signal component in order to reduce the L−R distortion which results from the second harmonic correction component produced by such a transmitter.

It is therefore an object of the present invention to provide a new and improved compatible independent sideband multiphonic, for example stereophonic, AM transmitter wherein a desired second harmonic correction of the stereo difference signal can be provided using a simple and economical circuit arrangement.

It is another object of the present invention to provide a new and improved ISB AM multiphonic, for example stereophonic, system wherein the transmitter and the receiver may be proportioned to provide a selected amount of linearity and independence with respect to the transmission of L and R signals through the system, providing a system with low distortion including, particularly, low intermodulation distortion.

It is still another object of the present invention to provide a new and improved ISB AM multiphonic, for example stereophonic, receiver decoder wherein the difference signal component of the received ISB AM stereo signal is modified in an inverse modulator by a selected non linear function of the sum signal component to reduce distortion which is present in the stereo difference signal component of the received ISB signal.

As used herein and in the appended claims, the term "inverse modulation" means the process whereby a first signal (A) is modulated by a second signal (B) in accordance with a selected modulation function having the general form 1/f(B).

SUMMARY OF THE INVENTION

In accordance with the present invention, there is provided an improved ISB AM multiphonic system transmitter which includes means for supplying a pair of audio frequency signals, L and R, representative of left and right multiphonic information. The transmitter also includes means, responsive to the L and R signals, for developing therefrom sum and difference signals having components of the L and R signals of selected amplitudes and phases combined in a predetermined manner. The transmitter further includes means for developing a phase modulated carrier signal, the modulation of which represents the difference signal inversely modulated by the sum signal in accordance with a first selected modulation function. The transmitter finally includes means for amplitude modulating the phase modulated carrier signal by the sum signal to form a composite ISB AM multiphonic signal.

In accordance with another aspect of the present invention there is provided an improved ISB AM multiphonic system comprising the transmitter described in the preceding paragraph and a receiver decoder, the latter of which includes means for supplying a received intermediate frequency (IF) ISB AM multiphonic signal. The decoder also includes means, responsive to the supplied IF signal, for modifying the difference signal component thereof in accordance with a selected function of the sum signal component, and for deriving at least a pair of audio frequency output signals, each representative of a corresponding one of the original L and R input signals to the transmitter whereby the inverse modulation function in the transmitter and the modification function in the receiver decoder may be chosen to provide a selected amount of linearity and independence with respect to the transmission of the L and R signals through said system, providing a system with low distortion including, particularly, low intermodulation distortion.

In accordance with still another aspect of the present invention there is provided an improved ISB AM multiphonic receiver decoder which includes means for supplying a received intermediate frequency (IF) ISB AM multiphonic signal. The decoder also includes means for inverse modulating the difference signal component of the received signal by the sum signal component in accordance with a second selected modulation function. The decoder finally includes means, responsive to the sum signal component and the inverse modulated difference signal component, for deriving therefrom a pair of audio frequency output signals, each of which is representative of a corresponding one of the original L and R input signals used at the transmitter to develop the transmitted ISB AM multiphonic signal.

Although the present invention is described herein generally in the context of a stereo system, those skilled in the art will recognize that L and R input signals to the transmitter may be multiphonic signals other than the stereo signals conventionally designated as L and R. For example, the input signals may be matrix quadraphonic signals $L_T$ and $R_T$ which would be transmitted through the system in the same manner as the L and R stereo signals. Provision can then be made for quadraphonic decoding at the receiver, so as to derive the four desired quadraphonic signals ($L_F$, $L_B$, $R_R$ and $R_B$).

For a better understanding of the present invention, together with other and further objects thereof, reference is made to the following descripion, taken in conjunction with the accompanying drawings, and its scope will be pointed out in the appended claims.

DESCRIPTION OF THE INVENTION

As described hereinabove, the prior art ISB transmitter of the type illustrated in FIG. 2 includes a second harmonic correction signal which is added to the stereo difference signal prior to phase modulating the carrier signal in phase modulator 20. In accordance with the present invention, as shown in the ISB transmitter of FIG. 3, the desired second harmonic correction is achieved by inverse modulating the stereo difference signal component by the sum signal component, rather than by adding a correction signal. The inverse modulation is in accordance with a selected modulation function which will be described hereinafter.

Figure 3:
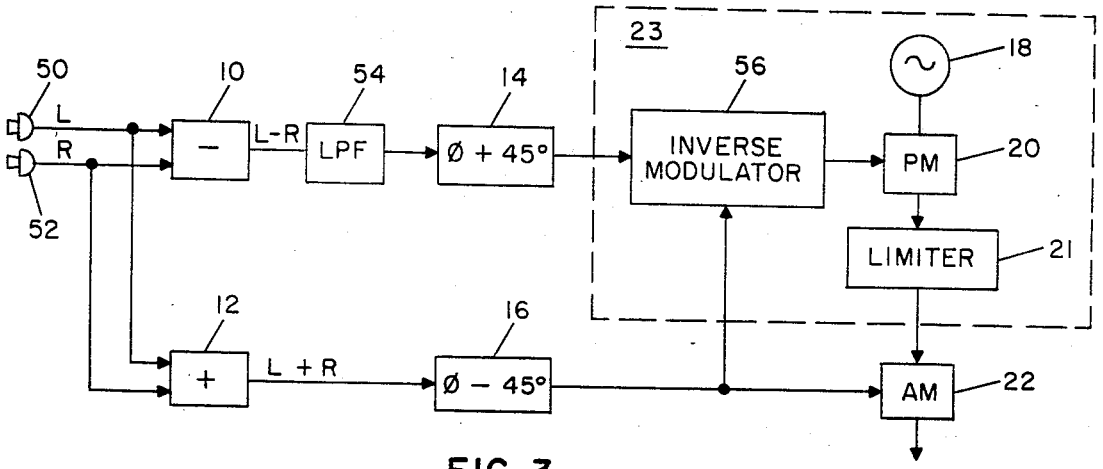
FIG. 3 is a block diagram of an ISB AM multiphonic transmitter in accordance with the present invention.
Figure 4:
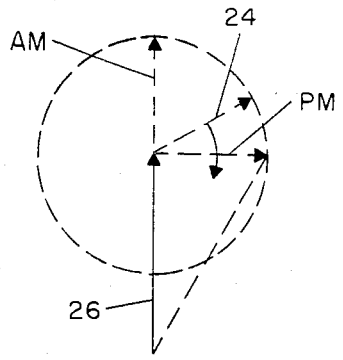
FIG. 4 is a phasor diagram useful in illustrating the amplitude and phase modulated signals of the present invention.
Figure 5:
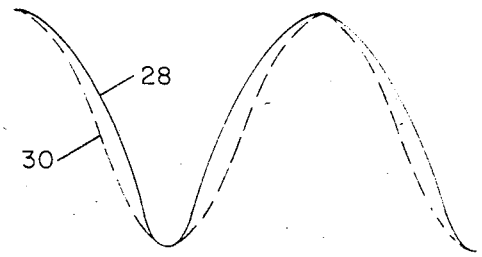
FIG. 5 is a signal diagram illustrating the amplitude of the FIG. 4 signal.

The FIG. 3 transmitter includes combiners 10 and 12 which generate the stereo difference signal L−R and stereo sum signal L+R, respectively, in response to the L and R stereo signals which may originate from any stereo signal source such as, for example, separated microphones 50 and 52. The stereo difference signal optionally may be acted on by a low pass filter 54 to limit the upper audio frequencies of that signal to about 5 KHz. Such filtering is conventional for the stereo difference channel, as is shown in U.S. Pat. No. 3,908,090. When such a low pass filter is used in the difference channel, those skilled in the art will recognize that it may be desirable to include delay equalization in the sum channel. Phase shift networks 14 and 16 act on the stereo sum and difference signals to cause them to have substantially a 90° phase difference with respect to each other.

In accordance with the FIG. 3 embodiment of the present invention, the stereo difference signal is inversely modulated by the stereo sum signal in accordance with a selected modulation function. Such inverse modulation eliminates the need to generate and add a second harmonic correction signal to the difference signal, as is done in the prior art FIG. 2 transmitter arrangement. This inverse modulation is accomplished in modulator 56. In the embodiment of FIG. 3, following inverse modulation of the stereo signal, the difference and sum signals are used to phase and amplitude modulate, respectively, the carrier in the conventional manner.

It will be recognized that the combination of elements 56, 18, 20 and 21, designated by the dotted box 23, represent one specific embodiment of means for developing a phase modulated carrier signal, the modulation of which represents the stereo difference signal inversely modulated by the stereo sum signal in accordance with a selected modulation function. Other embodiments may be realized by those skilled in the art.

Figure 1:
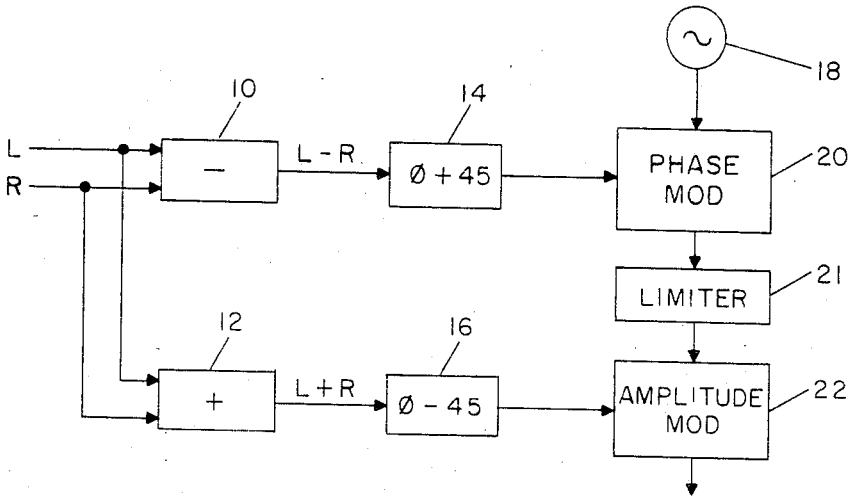
FIG. 1 (PRIOR ART)
FIG. 1 is a block diagram of a prior art independent sideband (ISB) AM stereo transmitter.
Figure 2:
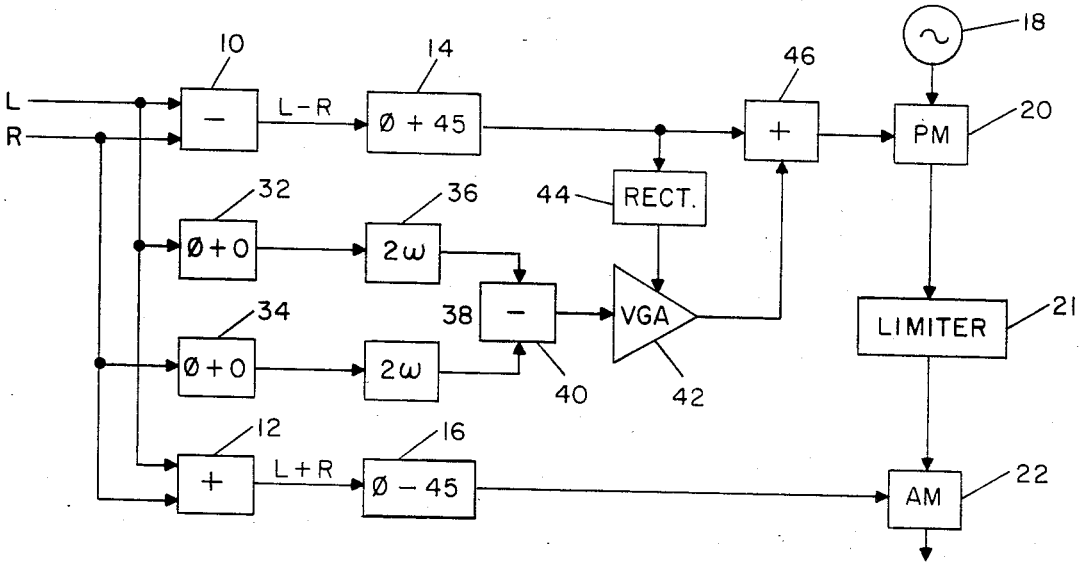
FIG. 2 (PRIOR ART)
FIG. 2 is a block diagram of an improved prior art ISB AM stereo transmitter.

A simplified analysis of the signals involved will show that the transmitter arrangements of FIG. 2 and FIG. 3 can provide substantially the same type of second harmonic correction, while the FIG. 3 arrangement requires less circuitry and produces less intermodulation distortion. The following simplified analysis assumes that a signal is supplied to the transmitter on only a single stereo channel, for example the L channel, and the signal has a constant amplitude and a phase velocity $\omega_a$. To normalize modulation indices, assume a signal with sufficient amplitude to cause full modulation when both L and R are present in equal amplitudes. Then, when only L or R is present the modulation is only one-half of the maximum total modulation possible in the stereo system. Thus, for L or R only the resulting signal has modulation indices of $(m_a/2)$ and $(m_p/2)$ for the amplitude and phase modulation respectively. Using the simplified prior art transmitter of FIG. 1, the output of phase modulator 20 ($S_1$), not expressing the carrier time variation (i.e.; using vector notation), can be expressed as follows:

$$s_1 = \cos\phi - j\sin\phi \tag{1}$$

where $\phi$=phase modulation=$(m_p/2)\sin\omega_a t$ for the case where $\phi$ is small; i.e. simplified analysis $$\cos\phi \simeq 1 - \frac{\phi^2}{2} \text{ and}$$

$$\sin\phi \simeq \phi$$

Thus:

$$s_1 = \left(1 - \frac{m_p^2}{8}\sin^2\omega_a t\right) - j\frac{m_p}{2}\sin\omega_a t$$

This signal is then amplitude modulated in modulator 22 to achieve the following output signal ($S_2$):

$$s_2 = \left[1 + \frac{m_a}{2}\cos\omega_a t\right]\left[\left(1 - \frac{m_p^2}{8}\sin^2\omega_a t\right) - j\frac{m_p}{2}\sin\omega_a t\right] \tag{3}$$

using $\sin^2\omega_a t = \frac{1}{2} - \frac{1}{2}\cos 2\omega_a t$:

$$s_2 = \left[1 + \frac{m_a}{2}\cos\omega_a t\right]\left[\left(1 - \frac{m_p^2}{16}\right) + \frac{m_p^2}{16}\cos 2\omega_a t - j\frac{m_p}{2}\sin\omega_a t\right] \tag{4}$$

Using $\cos\omega_a t \sin\omega_a t = \frac{1}{2}\sin 2\omega_a t$, and ignoring terms of $m^x$ with $x>2$ (simplified analysis):

$$s_2 = \underbrace{\left(1 - \frac{m_p^2}{16}\right)}_{\text{carrier}} + \underbrace{\frac{m_a}{2}\cos\omega_a t}_{\text{fundamental AM}} \underbrace{- j\frac{m_p}{2}\sin\omega_a t}_{\text{fundamental PM}} + \underbrace{\frac{m_p^2}{16}\cos 2\omega_a t}_{\text{2nd harmonic AM}} \underbrace{- j\frac{m_a m_p}{8}\sin 2\omega_a t}_{\text{2nd harmonic PM}} \tag{5}$$

Equation (5) is a simplified version of the output from transmitter 22 illustrating the components of the signal which have substantial amplitudes. All components which include a modulation term greater than the second power have lower amplitudes and have been ignored. In considering the components of the equation (5) signal, it is recognized that there is included a carrier signal term, and fundamental and second harmonic sideband terms. Single sideband operation for the fundamental terms is achieved by making $m_a=m_p=m$, so that the amplitude of the fundamental AM and PM terms are equal. Thus, the output signal will have a component at the carrier frequency, and a component at one fundamental sideband frequency. It should be noted that equating $m_a$ and $m_p$ does not equalize the second harmonic AM and PM terms, so that dual second harmonic sidebands remain. Actually, the second harmonic PM term is twice as large as necessary to produce a second harmonic single sideband. This term results from the multiplicative nature of a system where a phase modulated carrier is then amplitude modulated (a PM×AM system). The addition of a subtracting correction signal to the stereo difference signal in the prior art transmitter of FIG. 2 equalizes the second harmonic PM and AM terms to achieve single sideband operation for the fundamental and second harmonic terms.

In accordance with the present invention, it has been determined that a desired second harmonic correction can be implemented in an ISB AM stereo transmitter by developing a phase modulated carrier the modulation of which represents the stereo difference signal inversely modulated by the stereo sum signal in accordance with a selected modulation function. When this scheme is implemented according to the embodiment of FIG. 3, the quadrature term, which is mainly responsible for the phase modulation, of the composite output signal can be expressed as follows:

$$Q = \left(-j\frac{m_p}{2}\sin\omega_a t\right)\frac{1+\frac{m_a}{2}\cos\omega_a t}{1+m_t\frac{m_a}{2}\cos\omega_a t} \quad (6)$$

where the modulation function has been selected as:

$$\frac{1}{1+m_t\frac{m_a}{2}\cos\omega_a t} \quad (7)$$

Using the general relation:

$$\frac{1}{1+y} = 1 - y + y^2 \ldots$$

Then:

$$Q = -j\frac{m_p}{2}\sin\omega_a t\left[1+\frac{m_a}{2}\cos\omega_a t\right]\left[1 - m_t\frac{m_a}{2}\cos\omega_a t\ldots\right] \quad (8)$$

$$= -j\frac{m_p}{2}\sin\omega_a t - j\frac{m_p}{2}\sin\omega_a t\left(\frac{m_a}{2} - m_t\frac{m_a}{2}\right)\cos\omega_a t + \ldots \quad (9)$$

Selecting the phase modulation constant to be equal to the amplitude modulation constant and equal to m, and selecting a modulation factor $m_t=\frac{1}{2}$ for example, the phase modulation term can be expressed as follows:

$$Q = -j\frac{m}{2}\sin\omega_a t - j\frac{m^2}{16}\sin 2\omega_a t \quad (10)$$

It should be noted that the amplitude of the second harmonic PM term is ($m^2/16$), which is equal to the amplitude of the second harmonic AM term in equation (5). Consequently, the simplified analysis indicates that using the inverse modulation technique embodied in the transmitter of FIG. 3, such inverse modulation can modify the PM term of the composite signal, by partially compensating for the multiplicative effect of the AM, to equalize the second harmonic PM and AM terms and provide a true single sideband signal for a single input stereo signal L. Thus, a composite ISB signal is achieved for both L and R inputs.

The modified phase modulated signal from the limiter 21, produced by adding a correction signal to the stereo difference signal, according to the block diagram of FIG. 2, is substantially equivalent to the modified phase modulated signal produced by inverse modulation in accordance with the block diagram of FIG. 3 when using a modulation function of the form $1/(1+m_t x)$ with modulation factor ($m_t$) equal to one-half. In this modulation function (x) represents the sum signal. This equivalence can be seen by considering the fact that the phase modulation term has been modified by a second harmonic component whose amplitude is effectively one eighth the amplitude of the first order sideband component, when $m_a=m_p=m=1$. This amplitude corresponds to the 13% maximum amplitude of the correction signal used in the prior art transmitter of FIG. 2 as disclosed in U.S. Pat. No. 3,908,090.

Figure 6:
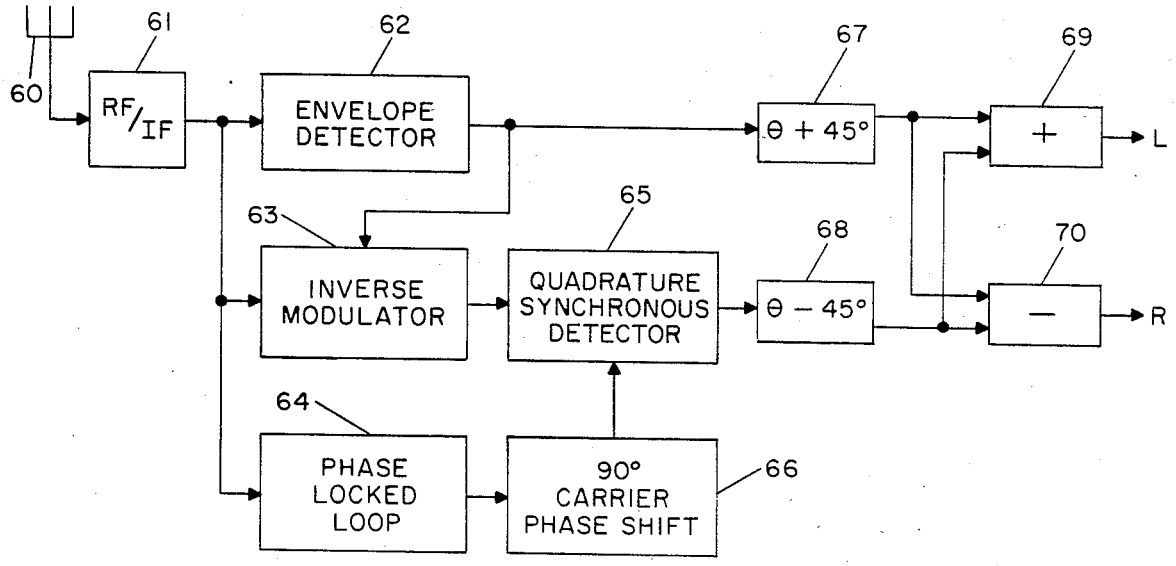
FIG. 6 is a block diagram of an ISB AM stereo receiver in accordance with the present invention.

In accordance with the receiver aspect of the invention, FIG. 6 illustrates one embodiment of a simplified ISB AM stereo receiver in which inverse modulation of the stereo difference signal component by the stereo sum signal component in accordance with a selected nonlinear modulation function is used to substantially cancel from the difference signal component the second harmonic correction component produced by an ISB AM stereo transmitter of the type shown either in FIG. 2 or 3. Such inverse modulation substantially eliminates the L−R distortion which results from the introduction of such second harmonic correction component Except for inverse modulator 63, the remainder of the ISB AM stereo receiver shown in FIG. 6 may be identical with elements 10, 14, 18, 20, 30, 34, 68, 60, 64 and 66 shown in FIG. 1 of U.S. Pat. No. 4,018,994 and described therein. For example, elements 60, 61, 62, 64, 66, 65, 67, 68, 69 and 70 of FIG. 6 of the present drawings correspond to elements 10, 14, 18, 20, 30, 34, 68, 60, 64 and 66, respectively of FIG. 1 of U.S. Pat. No. 4,018,994, and so need not be described in detail herein.

It should be noted, however, that the embodiment of FIG. 6 is less complex than the receivers shown in FIGS. 1, 2 and 3 of U.S. Pat. No. 4,018,994 in that in the receiver of present FIG. 6, a single inverse modulator 63 having a selected nonlinear modulation function replaces the elements 40, 52, 54, 44 and 28 shown in FIG. 1, for example, of the patent. Preferrably, the nonlinear modulation function is of the general form $(1/(1+m_t x)$.

Figure 7:
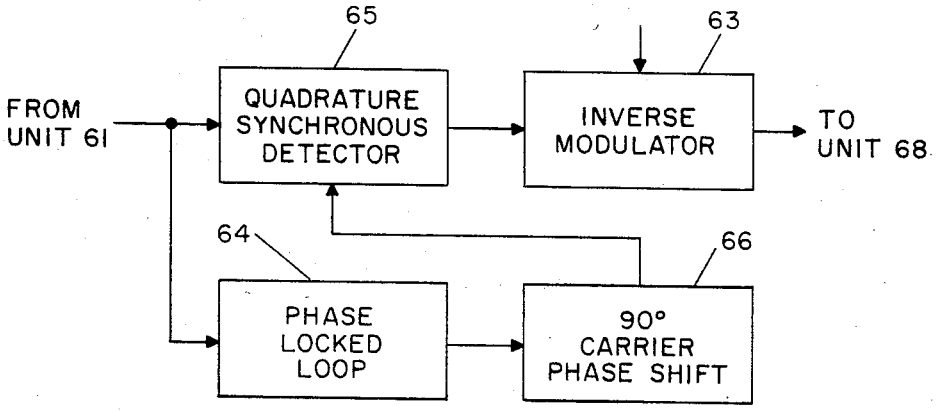
FIG. 7 is a block diagram showing an alternative arrangement for a portion of the receiver of FIG. 6, also in accordance with the present invention.

FIG. 7 shows an alternative embodiment of a portion of the ISB AM stereo receiver of FIG. 6. In this embodiment inverse modulation occurs after the stereo difference signal component has been detected in quadrature demodulator 65. The net result, however, is the same; namely that the L−R distortion which results from the second harmonic correction component produced by the transmitters of FIGS. 2 and 3 is substantially eliminated by the inverse modulation of the detected difference signal component which takes place in inverse modulator 63.

In accordance with the system aspect of the present invention, when the ISB AM stereo signal generated by the transmitter of FIG. 3 is received by an ISB AM stereo receiver of the type shown in FIG. 6, a second inverse modulation occurs in inverse modulator 63 which, as described earlier herein, corrects for the distortion that intentionally exists in the L−R phase modulation of the transmitter to develop a true single sideband signal. This inverse modulation in the receiver may be performed on the composite IF signal as shown in FIG. 6 or the stereo difference signal may be modified directly after it has been demodulated, as shown in FIG. 7.

In accordance with the overall system aspects of the invention, the difference signal inverse modulation function in the transmitter and the difference signal inverse modulation function in the receiver may be selected so that the overall system has a signal translation characteristic for the stereo difference signal, and therefore for the L and R stereo signals, which has a desired amount of linearity and independence with respect to the transmission of L and R signals through the system, from the L and R inputs to the transmitter of FIG. 3 to the L and R outputs from the receiver of FIG. 6 or 7. Specifically the two inverse modulations functions can be selected so that the overall system has low distortion including, particularly, low intermodulation distortion. The prior art FIG. 2 transmitter provides a L−R correction signal which, in effect, operates in response to L and R separately such that the transmitter produces some intermodulation distortion, particularly when a strong signal exists in both L and R at different frequencies.

The overall system characteristic responsible for distortion in the stereo difference channel is the multiplicative nature of the PM×AM process in the transmitter. This, without correction, would result in the L−R signal being multiplied by $(1+x)$, where x is the sum signal. Therefore, for ideal operation, the product of the two inverse modulation functions, at the transmitter and receiver respectively, should provide a modulation function of the form $1/(1+x)$ to cancel out the multiplicative effect in the L−R channel. For example, if the inverse modulation in the transmitter of FIG. 3 and the receiver of FIG. 6 are both selected to have a modulation function of $1/(1+m_t x)$, with $m_t=\frac{1}{2}$, the overall system L−R signal translation characteristic will be approximately linear and therefore substantially free from distortion including intermodulation distortion. Exact linearity, and therefore distortion free operation, may be achieved by using inverse modulation at the transmitter having a modulation function of $(1+m_t x)/(1+x)$ and an inverse modulation at the receiver with a modulation function of $1/(1+m_r x)$, and with $m_r=m_t$. With such a transmitter modulation function, as x approaches $(-1)$, so $(1+x)$ approaches zero, the gain would approach infinity. Therefore some practical limit needs to be placed upon the maximum gain (such as less than 10 times) in such a nonlinear function. The above described pair of modulation functions could be reversed between the transmitter and receiver. However, this would create a problem of excess gain in the L−R channel of the receiver with excessive noise upon downward AM when $(1+x)$ approaches zero.

Good linearity, low distortion and low intermodulation distortion will result in the overall system if the product of the transmitter and receiver modulation functions used for inverse modulation approximate the ideal of $1/(1+x)$. Many possible combinations exist which approach this ideal and are considered to be within the spirit of this invention.

While there has been described what is believed to be the preferred embodiment of the invention, those skilled in the art will recognize that other and further modifications may be made thereto without departing from the spirit of the invention, and it is intended to claim all such embodiments as fall within the true scope of the invention.

I claim:

1. An improved ISB AM multiphonic system transmitter, comprising:

means for supplying a pair of audio frequency signals, L and R, representative of left and right multiphonic information, respectively;

means responsive to said L and R signals, for developing therefrom sum and difference signals having components of said L and R signals of selected amplitudes and phases combined in a predetermined manner, said sum and difference signals having a relative phase difference of approximately 90° over a substantial portion of the frequency band that is common to said signals;

means for developing a phase modulated carrier signal, the modulation of which represents said difference signal inversely modulated by said sum signal in accordance with a modulation function of the form $(1+m_t x)/(1+x)$;

and means for amplitude modulating said phase modulated carrier signal by said sum signal to form a composite ISB AM multiphonic signal having low intermodulation distortion.

2. A transmitter in accordance with claim 1 wherein $m_t=\frac{1}{2}$.

* * * * *